US005140963A

United States Patent [19]

Brackett et al.

[11] Patent Number: 5,140,963

[45] Date of Patent: Aug. 25, 1992

[54] FUEL RAIL MOUNTING FOR A FUEL INJECTOR

[75] Inventors: Stephen E. Brackett, Blenheim; Lloyd Cole, Tecumsch, both of Canada

[73] Assignee: Siemens Automotive Limited, Chatham, Canada

[21] Appl. No.: 717,957

[22] Filed: Jun. 20, 1991

[51] Int. Cl.[5] ..... F02M 55/02

[52] U.S. Cl. ..... 123/470; 123/456

[58] Field of Search ..... 123/470, 456, 469, 472, 123/468; 239/600, 585

[56] References Cited

U.S. PATENT DOCUMENTS

| | | | |
|---|---|---|---|
| 4,475,516 | 10/1984 | Atkins | 123/470 |
| 4,556,034 | 12/1985 | Anklam | 123/470 |
| 4,601,275 | 7/1986 | Weinand | 123/456 |
| 4,950,171 | 8/1990 | Muzslay | 123/470 |
| 4,966.120 | 10/1990 | Itoh | 123/456 |
| 5,016,594 | 5/1991 | Hafner | 123/456 |
| 5,030.116 | 7/1991 | Sakai | 123/470 |
| 5,058,554 | 10/1991 | Takeda | 123/470 |
| 5,058,555 | 10/1991 | Haboush | 123/456 |

*Primary Examiner*—Carl S. Miller

*Attorney, Agent, or Firm*—George L. Boller; Russel C. Wells

[57] ABSTRACT

Tabs and slots are provided on a fuel injector and a fuel rail respectively to provide for the injector to be installed in a transverse through-hole in the fuel rail by circumferentially registering the tabs with the slots, inserting the injector into the through-hole to a predetermined depth, and then twisting the injector about its own axis to remove the tabs from their insertion registry with the slots and cause the injector to become axially captured in the through-hole by the tabs being axially captured within circumferential extensions of the slots that are cooperatively axially defined by a shoulder in the through-hole and an overhang.

7 Claims, 2 Drawing Sheets

FUEL RAIL MOUNTING FOR A FUEL INJECTOR

FIELD OF THE INVENTION

This invention relates generally to internal combustion engine fuel systems and more specifically to the mounting of electrically operated fuel injectors on such fuel rails, especially bottom-feed fuel injectors.

BACKGROUND AND SUMMARY OF THE INVENTION

A bottom-feed electrically operated fuel injector is typically characterized by the fact that its fuel inlet is disposed proximal to its fuel outlet and distal to its electrical connector. For example, the fuel inlet may be disposed in the sidewall of the injector body while the fuel outlet is disposed at one axial end of the body and the electrical connector is disposed at the opposite axial end of the body. The typical mounting of such a fuel injector on a fuel rail comprises the fuel injector being disposed in a transverse through-hole in the rail such that: the injector's fuel inlet is in fluid communication with a main longitudinal fuel passage in the fuel rail; the fuel injector's body is sealed to the wall of the transverse through-hole on axially opposite sides of the injector's fuel inlet; the injector's electrical connector is disposed at one axial end of the transverse through-hole so as to be available for connection to a mating electrical connector that delivers operating current to the injector; and the injector's outlet is disposed at opposite axial end of the through-hole for injecting fuel into the engine for entrainment with combustion air.

It is a typical practice to mount a bottom-feed fuel injector on a fuel rail by inserting the fuel injector, outlet end first, into the transverse through-hole in the fuel rail until the insertion is arrested by abutment with an abutment stop located a predetermined distance inside the through-hole. A cover, which may include an electrical connector for connecting to the electrical connector of the fuel injector, is then disposed over the proximal end of the injector and fastened to the fuel rail to capture the installed injector in the through-hole. Examples of known practices are evidenced by U.S. Pat. Nos. 4,475,486; and 4,844,036. An example of a clip attachment for a top-feed injector is shown by U.S. Pat. No. 4,475,516.

Circumferential orientation of a fuel injector within a transverse through-hole in a fuel rail may also be important. Such is usually the case where the injector is of the split-stream type. It is therefore desirable to provide a circumferential locator for assuring the proper circumferential orientation of a fuel injector in a transverse through-hole in a fuel rail. Examples are evidenced by certain commonly assigned co-pending applications that are known to the USPTO by virtue of their pendency.

The present invention relates to a novel mounting of an electrically operated fuel injector on a fuel rail which may be especially useful for certain engine applications. The invention comprises the inclusion of a keying means associated with one of the through-hole and the injector and a keyed means associated with the other of the through-hole and the injector. The keying means and keyed means are effective to permit the one of them that is associated with the fuel injector to pass axially through the other of them that is associated with the through-hole during insertion of the fuel injector into the through-hole, provided that the fuel injector is properly circumferentially oriented to register the keyed means with the keying means, and to permit the fuel injector to be twisted about its own axis after having been fully inserted into the through-hole such that the keying means and the keyed means are removed from registry and are instead placed in an interference relationship preventing the fuel injector from being extracted from the through-hole. An abutment stop is also provided on the one of the keying means and keyed means that is associated with the through-hole for abutment with the other of the keying means and the keyed means for the purpose of limiting the extent to which the fuel injector can be twisted once the fuel injector has been fully inserted into the through-hole, thus enabling the fuel injector to be properly circumferentially oriented within the through-hole. The disclosed embodiment of the invention comprises a pair of locking tabs on the fuel injector body which constitute the keyed means and a pair of slots in the through-hole which constitute the keying means. The slots are formed integrally with the fuel rail and include circumferential extensions which the tabs enter upon the injector being twisted.

Further details of the invention, along with advantages and benefits of the invention, will be seen in the ensuing description which is accompanied by drawings. The drawings disclose a preferred embodiment of the invention according to the best mode contemplated at the present time for carrying out the invention.

DESCRIPTION OF THE PREFERRED EMBODIMENT

Figure 1:
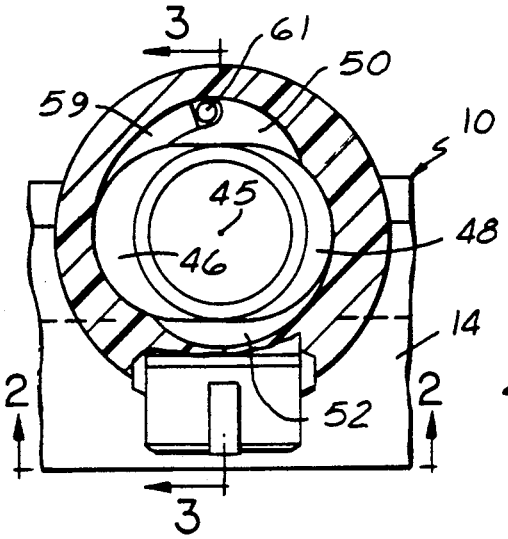
FIG. 1 is a transverse cross-sectional view through a fuel injector in the process of being installed on a fuel rail in accordance with principles of the present invention.

FIGS. 1-4 show a portion of a fuel rail assembly 10 containing several electromagnetically operated fuel injectors 12 mounted on a fuel rail 14 at intervals along the fuel rail's length. Fuel rail 14 comprises several transverse through-holes 16, and there is one fuel injector 12 disposed in each through-hole 16.

Each through-hole 16 comprises, in the direction from its inner end to its outer end, a radially inwardly facing circular sidewall section 18*a*, a frusto-conical taper 18*b*, a radially inwardly facing circular sidewall section 18*c*, a frusto-conical taper 18*d*, an axially facing shoulder 18*e*, and a radially inwardly facing sidewall section 18*f*. A main longitudinal fuel passage 22 through fuel rail 14 intersects the sidewall section 18*c* of each through-hole 16 in a generally tangential manner.

Fuel injector 12 comprises a body 24 having a generally cylindrical shape. The fuel outlet 26 of the injector is at the axial end of body 24 that is disposed at the inner end of through-hole 16 while the electrical connector 28 of the injector is at the opposite axial end of body 24 and disposed exterior of the outer end of the through-hole. Connector 28 comprises two electrical terminal pins 30, 32 adapted for connection to mating receptacles in a mating connector (not shown) which delivers electric current for operating the fuel injector. The fuel inlet of the injector is provided by a circular groove 34 in the side of body 24 leading to one or more circular holes 36 extending into the interior of the injector.

Figure 2:
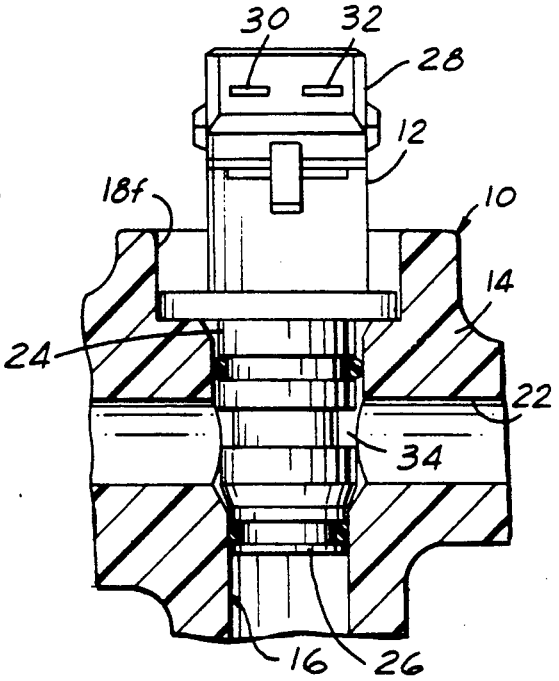
FIG. 2 is a view, partly in cross section, through FIG 1 in the direction of arrows 2—2.
Figure 4:
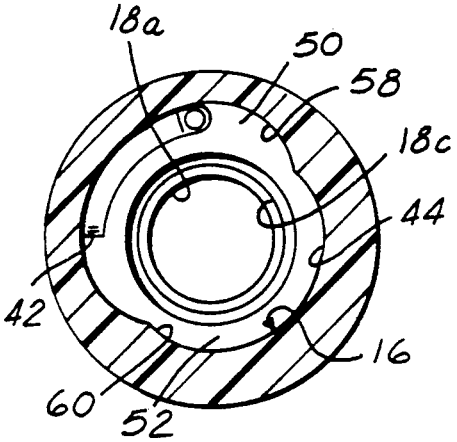
FIG. 4 is a fragmentary view in the same sense as FIG. 1, but omitting the fuel injector.

FIG. 2 illustrates the fuel injector in the fully installed position on the fuel rail. Circular O-ring seals 38, 40 are disposed on body 24 to seal between the body and through-hole 16 on axially opposite sides of groove 34 so that fuel which passes into the interior of the injector from fuel passage 22 via groove 34 and hole(s) 36 does not leak out through-hole 16. The O-ring seals 38, 40 are disposed around the outside of body 24 and in the installed position each provides a radial seal.

In accordance with principles of the invention, through-hole 16 is provided with a keying means, and injector 12 with a keyed means. The keying means is in the form of a pair of slots, or keyways, 42, 44 in the through-hole that are formed integrally with the fuel rail. The keyways extend into the fuel injector from the open upper end of the through-hole parallel to the through-hole's axis. They terminate at shoulder 18*e*. When viewed in the direction of FIG. 1, the two keyways are seen to be at approximately opposite ends of an elongated circle that is somewhat eccentric to the through-hole's axis 45.

The keyed means comprises a pair of tabs, or keys, 46, 48 on diametrically opposite sides of that portion of body 24 that, in the fully installed position of the fuel injector in the through-hole, is axially co-extensive with a lower portion of sidewall section 18*f*. Tab 46 is somewhat larger than tab 48. As viewed in FIG. 1, the perimeters of the two tabs are essentially congruent with the elongated circle referred to in the preceding paragraph. Tabs 46, 48 register with keyways 42, 44 respectively when the injector is circumferentially positioned in relation to through-hole 16 in the manner of FIGS. 1 and 2. The tabs are sized slightly smaller than their respective keyways, so that when registered therewith, they will pass axially through the keyways as the fuel injector is being inserted, outlet end first, into the through-hole.

The fuel injector is assembled into the fuel rail by insertion in this manner until the tabs abut shoulder 18*e*. The fuel injector is then rotated approximately ninety degrees clockwise about its co-axis with axis 45 as viewed in FIG. 1. This causes the tabs to lodge in respective circumferential extensions 50, 52 of the two slots. These circumferential extensions begin at the inner ends of their respective slots and extend therefrom approximately ninety degrees. They are axially cooperatively defined by shoulder 18*e* and by radially inwardly directed overhangs 54, 56. Their axial dimension is essentially constant throughout and just slightly less than the thickness of the two tabs which is also essentially constant throughout. The circumferential extensions 50, 52 are shaped to provide circumferential abutment stops in the regions indicated by the numerals 58, 60. After the approximately ninety degrees of twisting about its co-axis with axis 45 from the position of FIG. 1, the fuel injector's tabs will be abutting regions 58, 60, and therefore the fuel injector cannot be twisted any farther. Thus the tabs form a circumferential locator for assuring desired circumferential orientation of the fuel injector in the through-hole. The electrical connector (not shown) that delivers operating current to the fuel injector can then be mated with connector 28 of the fuel injector. It may be desirable to include a detent feature whereby at the completion of injector twisting, a small nubbins on the underside of tab 46 which had been riding along a slight ramp 59 in shoulder 18*e* registers with a dimple 61 at the end of the ramp. Thus, the injector snaps into place upon arrival at the fully installed position, and the feature may be designed to produce an audible sound, or click, as well as providing a detent feel.

Figure 3:
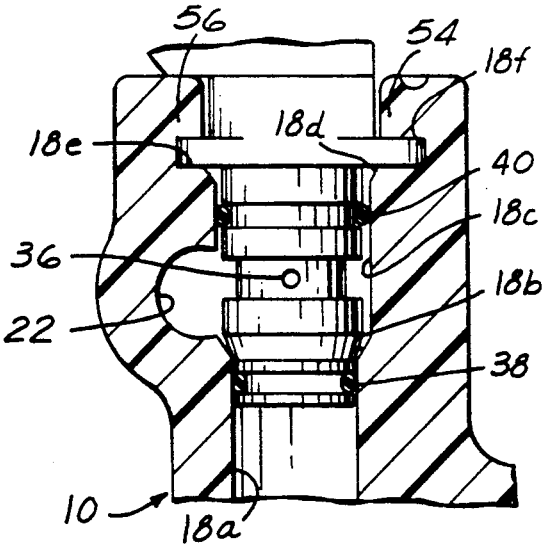
FIG. 3 is a view, partly in cross section, taken at ninety degrees to the view of FIG. 2 and showing the fully installed position of the fuel injector.
Figure 5:
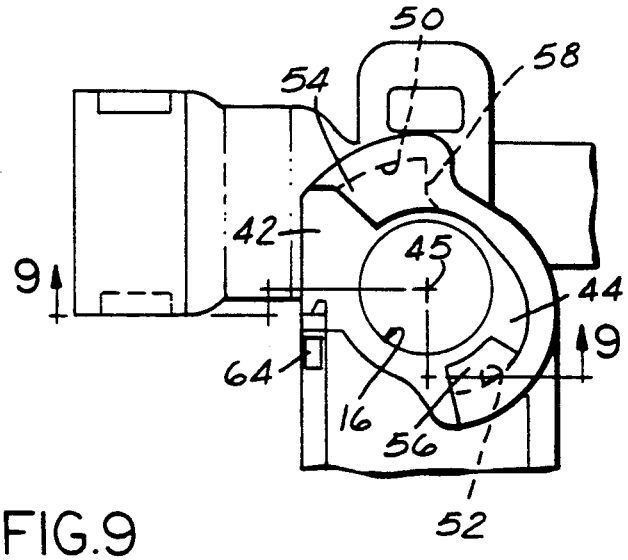
FIG. 5 is an axial end view of a transverse through-hole in a fuel rails and represents a modified form.
Figure 9:
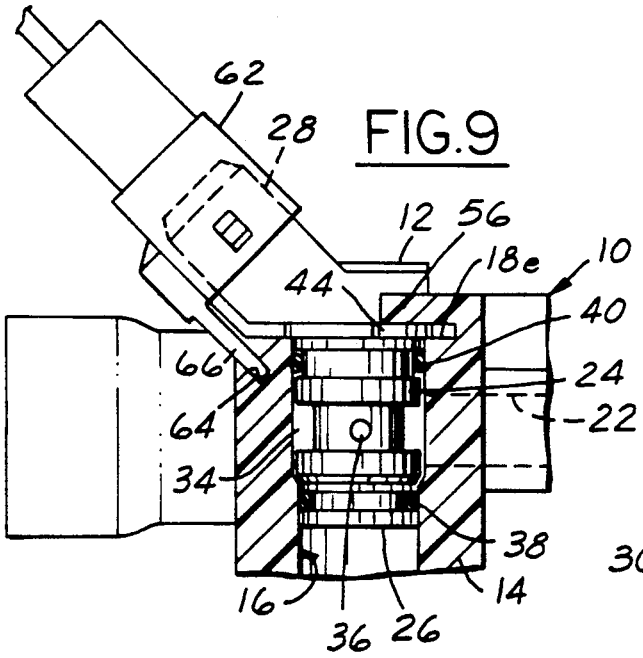
FIG. 9 is an elevational view, partly in cross section in the direction of arrows 9—9 in FIG. 5, showing the fuel injector of FIG. 6 fully installed on the fuel rail of FIG. 5, including completion of the electrical connection to the fuel injector.
Figure 6:
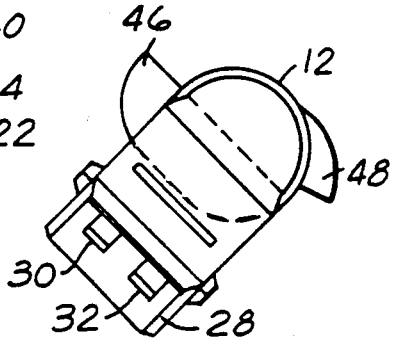
FIG. 6 is an axial end view of a fuel injector used with the fuel rail of FIG. 5.

From consideration of FIG. 1 it can be appreciated that on account of the particular shape and location of the tabs and slots, a polarization has been created whereby the fuel injector can be axially seated in the through-hole by initially disposing the fuel injector at only a single unique circumferential orientation relative to the through-hole. FIG. 3 shows that after the tabs have passed through the slots and the injector has bee twisted to move the tabs into the circumferential slot extensions and out of registry with the slots, the tabs are axially captured between the respective overhangs 54, 56 and should 18*e*. Twisting of the injector until the tabs abut the circumferential stops assures that the injector has been properly circumferentially oriented. Removal of an installed injector is accomplished in the opposite manner, namely by twisting the injector counterclockwise to register the tabs and slots, and then pulling the injector out of the through-hole.

The slots and their circumferential extensions are created integrally in the fuel rail by an suitable manufacturing procedure. Lost core molding is a procedure that can be advantageously used.

Figure 7:
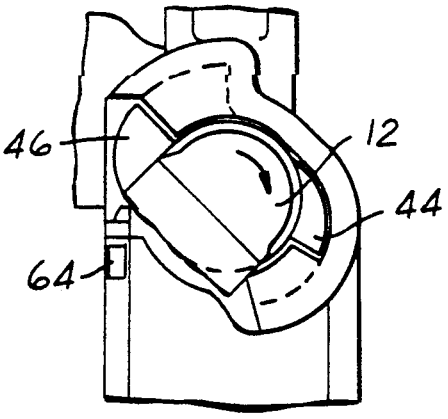
FIGS. 7 and 8 are axial end views showing respective steps in installing the fuel injector of FIG. 6 on the fuel rail of FIG. 5.
Figure 8:
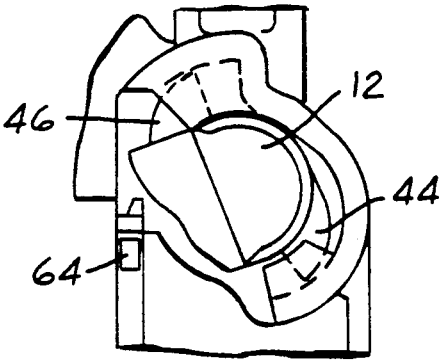

FIGS. 5–9 illustrate a modification wherein the same reference numerals used in FIGS. 1–4 are used to refer to corresponding parts. One difference in the embodiment of FIGS. 5–9 resides in the shapes of tabs 46, 48, slots 42, 44, and circumferential extensions 50, 52. The tabs and slots are designed for registry when the injector has the circumferential orientation of FIG. 6 relative to the through-hole orientation of FIG. 5. This is shown in FIG. 7. After the tabs have been passed through the slots to abut shoulder 18*e*, the fuel injector is twisted about its co-axis with axis 45 in the clockwise sense as viewed in FIG. 7. As the injector is so rotated, the tabs enter the slot extensions and become axially captured. FIG. 8 shows the condition after about twenty-two and one-half degrees of rotation. After an additional twenty-two and one-half degrees of rotation, the circumferential abutment occurs so that the total rotation is limited to about forty-five degrees. Removal of the fuel injector from the through-hole is accomplished in opposite manner.

With the fuel injector fully installed in the through-hole, it becomes possible to make the electrical connection to the injector's electrical connector 28. The electrical connector 28 of the FIGS. 5–9 embodiment differs from that of the FIGS. 1–4 embodiment in that the connector of FIGS. 5–9 is at approximately a forty-five degree angle to axis 45. An interlock feature is provided between the injector and the fuel rail whereby the electrical connector plug 62 that mates with connector plug 28 can be mated with connector plug 28 only after the fuel injector has been fully installed in the through-hole. This interlock feature is provided by the inclusion of a key on one of the injector and the fuel rail and a keyway on the other of the injector and the fuel rail. In the illustrated embodiment, a keyway 64 is provided in the fuel rail, and a key 66 is provided on the shell of connector plug 62. As the connector plug 62 is being mated to connector plug 28 after the fuel injector has been fully installed, key 66 enters keyway 64. After the connector and plug have been fully mated to establish the electrical connection to the fuel injector, the engagement of the shell of connector plug 62 with the fuel rail, by virtue of the interaction between key 66 and keyway 64, prevents the fuel injector from being rotated about the through-hole's axis, and thereby assures that the desired installation orientation will be maintained. To remove the fuel injector from the fuel rail, connector plug 62 must be first disconnected from connector 28.

Typically the fuel rail is fabricated from a suitable composite material. That portion of the fuel injector body which includes the integral tabs may be of similar material.

While a presently preferred embodiment of the invention has been illustrated and described, it should be appreciated that principles are applicable to other embodiments that fall within the scope of the following claims. While the illustrated fuel rail is intended to be mounted to an intake manifold of an engine, the fuel rail could be integrated into the manifold, and it is to be understood that use of the term "fuel rail" is intended to include both a separate as well as an integral fuel rail.

What is claimed is:

1. An internal combustion engine fuel rail assembly comprising a fuel rail having a main longitudinal passage that is intercepted by transverse through-holes at intervals along the length of the fuel rail, a bottom-feed electrically operated fuel injector disposed in each through-hole by having been inserted, one axial end first, into the through-hole and comprising a fuel inlet that is in fluid communication with said main longitudinal passage so that fuel can pass from said main longitudinal passage to the fuel injector, and mounting means providing for the removable mounting of each fuel injector in the corresponding through-hole characterized in that said mounting means comprises for each injector and the corresponding through-hole a shoulder within the through-hole, each injector and the corresponding through-hole comprising keying means and keyed means, said keying means being associated with the corresponding through-hole and said keyed means being associated with the injector, said keying means and said keyed means relating the injector and the through-hole such that the injector can be inserted into the through-hole in a limited number of discrete relative circumferential orientations of the injector and the through-hole, said keying means comprising circumferential extension means formed by overhanging means integrally formed with said fuel rail and cooperating with said shoulder to axially capture the injector in the through-hole after the fuel injector has been inserted into the through-hole and then twisted in one sense about its own axis a certain number of degrees relative to the through-hole, one of said keying means and said keyed means comprising circumferentially extending inclined ramp means that is effective on the other of said keying means and said keyed means during such twisting of the fuel injector, and said keying means and said keyed means comprising detent means effective after the effectiveness of said ramp means to distinctively circumferentially locate the fuel injector relative to the through-hole.

2. An assembly as set forth in claim 1 characterized further in that a further keying means and a further keyed means are provided between said fuel rail and an electrically connector plug that is mated with the fuel injector's connector to prevent the fuel injector from being twisted in the opposite sense and registering the first-mentioned keying means with the first-mentioned keyed means.

3. An assembly as set forth in claim 2 characterized further in that said keying means and said keyed means are configured to permit passage of one through the other during insertion of the injector into the through-hole for only a single unique circumferential orientation of the injector to the through-hole.

4. An assembly as set forth in claim 3 characterized further by an abutment stop that is disposed on said fuel rail to limit the extent to which the injector can be twisted about its own axis after it has been inserted into the through-hole and said keyed means have entered said circumferential extension means.

5. An assembly as set forth in claim 4 characterized further in that said abutment stop is disposed to allow about forty-five degrees of twisting of the injector in a particular direction about the injector's axis.

6. An internal combustion engine fuel rail assembly comprising a fuel rail having a main longitudinal passage that is intercepted by transverse through-holes at intervals along the length of the fuel rail, an electrically operated fuel injector disposed in each through-hole by having been inserted, one axial end first, into the through-hole and comprising a fuel inlet that is in fluid communication with said main longitudinal passage so that fuel can pass from said main longitudinal passage to the fuel injector, and mounting means providing for the removable mounting of each fuel injector in the corresponding through-hole characterized in that said mounting means comprises for each injector and the corresponding through-hole a shoulder within the through-hole, each injector and the corresponding through-hole comprising keying means and keyed means, said keying means being associated with the corresponding through-hole and said keyed means being associated with the injector, said keying means and said keyed means relating the injector and the through-hole such that the injector can be inserted into the through-hole in a limited number of discrete relative circumferential orientations of the injector and the through-hole, said keying means comprising circumferential extension means formed by overhanging means integrally formed with said fuel rail and cooperating with said shoulder to axially capture the injector in the through-hole after the fuel injector has been inserted into the through-hole and then twisted in one sense about its own axis a certain number of degrees relative to the through-hole, one of said keying means and said keyed means comprising circumferentially extending inclined ramp means that is effective on the other of said keying means and said keyed means during such twisting of the fuel injector, and said keying means and said keyed means comprising detent means effective after the effectiveness of said ramp means to distinctively circumferentially locate the fuel injector relative to the through-hole.

7. An internal combustion engine fuel system comprising an injector receptacle comprising a hole within which an electrically operated fuel injector disposed by having been inserted, one axial end first, into the hole, said fuel injector having a fuel inlet that is in fluid communication with said hole so that liquid fuel that has been delivered to said hole can pass to the fuel injector, and mounting means providing for the removable mounting of the fuel injector in the hole characterized in that said mounting means comprises for the injector and the hole a shoulder within the hole, the injector and the hole comprising keying means and keyed means, said keying means being associated with the hole and said keyed means being associated with the injector, said keying means and said keyed means relating the injector and the hole such that the injector can be inserted into the hole in a limited number of discrete relative circumferential orientations of the injector and the hole, said keying means comprising circumferential extension means formed by overhanging means integrally formed with said receptacle and cooperating with said shoulder to axially capture the injector in the hole after the fuel injector has been inserted into the hole and then twisted in one sense about its own axis a certain number of degrees relative to the hole, one of said keying means and said keyed means comprising circumferentially extending inclined ramp means that is effective on the other of said keying means and said keyed means during such twisting of the fuel injector, and said keying means and said keyed means comprising detent means effective after the effectiveness of said ramp means to distinctively circumferentially locate the fuel injector relative to the hole.

* * * * *